United States Patent [19]

Stenberg

[11] Patent Number: 4,923,164

[45] Date of Patent: May 8, 1990

[54] POST SUPPORT AND ANCHOR

[76] Inventor: Richard A. Stenberg, 14926 Inlet Ct., San Leandro, Calif. 94578

[21] Appl. No.: 246,334

[22] Filed: Sep. 19, 1988

[51] Int. Cl.[5] ..... F16M 13/00

[52] U.S. Cl. ..... 248/530; 52/165; 248/156; 248/160; 248/507; 403/224; 404/9

[58] Field of Search ..... 248/156, 545, 530, 533, 248/507, 508, 160; 404/9; 52/165, 296, 298; 403/224, 220, 2

[56] References Cited

U.S. PATENT DOCUMENTS

| | | | |
|---|---|---|---|
| 396,624 | 1/1889 | Thomas | 52/165 |
| 2,571,281 | 10/1951 | Neher | 403/220 X |
| 3,767,355 | 10/1973 | Anderson | 248/530 X |
| 4,004,383 | 1/1977 | Watanabe | 52/165 X |
| 4,105,350 | 8/1978 | O'Donnell | 403/220 |
| 4,249,715 | 2/1981 | Repp | 248/156 X |
| 4,469,956 | 9/1984 | D'Amato | 52/296 |
| 4,603,520 | 8/1986 | Deike | 52/296 X |
| 4,644,713 | 2/1987 | Lehman | 52/165 |
| 4,659,049 | 4/1987 | Watson | 248/156 X |

FOREIGN PATENT DOCUMENTS

| | | | |
|---|---|---|---|
| 125202 | 4/1919 | United Kingdom | 248/156 |
| 2030613 | 4/1980 | United Kingdom | 52/165 |

*Primary Examiner*—Alvin C. Chin-Shue
*Assistant Examiner*—David L. Talbott
*Attorney, Agent, or Firm*—Alvin E. Hendricson

[57] ABSTRACT

Four orthagonally oriented rigid blades are fixed together along a side of each and taper to a common pointed bottom with a rigid top plate affixed across the top of the blades and a steel tube extends upwardly from the plate to receive and support a post such as a sign post, fence post or the like extending upwardly from the device. The invention is adapted to be driven into the ground to support and anchor posts.

The invention also includes a "break away" embodiment incorporating a thick high density rubber retainer atop the rigid plate about the tube which has a flanged bottom beneath the rubber retainer and a rigid centrally apertured plate is bolted onto the top plate to hold the rubber retainer and tube on the top plate. A heavy blow to a post mounted in the tube will tilt the tube to pivot the flange thereof to deform the retainer and allow the tube and flange to flip out of the upper apertured plate as a break away feature without damage to the invention. The invention may be readily reassembled after break away by means of the bolts.

9 Claims, 2 Drawing Sheets

POST SUPPORT AND ANCHOR

The present invention provides a rigid anchor and support for sign posts, fence posts and the like and may be driven into the ground as a removable device that may incorporate a "break away" capability under heavy impact so as to be readily reassembled for reuse.

FIELD OF INVENTION

Commonly sign posts, fence posts and the like are placed in holes dug in the ground with soil being tapped thereabout or concrete poured thereabout to secure them in place. A variety of different types of post hole diggers have been developed for this purpose, however, considerable time and effort are required for their use and the use of concrete to hold the post in the ground requires additional time and material as well as posing a substantial problem for removal when such becomes necessary.

There have also been advanced various types of spears or spikes that may be attached to the bottom of a post and adapted to be driven into the ground as by a sledge hammer, however, these provide only very limited strength against lateral forces that may be applied to a post. Note in this respect U.S. Pat. Nos. 3,887,154; 4,249,715; 4,343,449 and 4,483,506 and prior art patents cited therein.

Although some applications of post supports may be satisfied by simple devices of the types noted above, other applications impose more stringent requirements. Thus, for example, many posts that are mounted in the ground must be capable of withstanding substantial lateral forces such as wind loading of signs mounted on posts. In other applications, the posts may be subject to high impact lateral forces such as may be caused by vehicles striking road signs carried by such posts. In these instances, the anchor mechanism should be capable of retaining their position in the ground even though the post supported thereby is forceably moved or even broken.

The present invention provides a simple and convenient solution to the foregoing problems.

SUMMARY OF INVENTION

The present invention provides a support and anchor system adapted to be driven into the ground and includes means for engaging a post in extension upwardly from the ground. Basically, the invention has a plurality of preferably four orthagonally disposed blades that taper inwardly toward the bottom of the system to a point for penetrating the ground. The upper ends of the blades are fixed together over the lengths thereof. Atop the plate or plates there is fixed an upright hollow rigid cylinder or tube having a rectangular, circular or other configuration to snugly receive the lower end of a post, pipe or the like to support the latter. The top rigid plate or plates have a substantial lateral dimension in excess of the cross sectional dimensions of the post to be supported so as to prevent tilting or tipping of the support and post when the blades are driven into the ground and the plate rests upon the surface of the ground.

Alternative manners of construction of the support system hereof are possible and one simple and inexpensive embodiment provides a pair of units with each having tapered edges and folded lengthwise with an integral top flap folded over and affixed to a folded side or blade. This pair of units are affixed together, as by welding, along longitudinal center line to form the orthagonal tapered blades and the hollow cylinder is fixed, as by welding, to the two top flaps forming the upper ground plate.

Certain applications of the present invention advantageously incorporate a "break away" feature which is preferably provided by flanging the lower end of the upright cylinder and holding it against the top ground plate by an apertured plate bolted thereto and clamping a height density, limetedly flexible, retaining sheet atop the container flange. When used to support a street or highway sign this embodiment allows the upright cylinder (and post fitted therein) to be driven off of the lower blade and plate assembly when the upper portion is struck by an automobile, for example. The structure provides for simple reassembly merely by undoeing the bolts and reseating the retainer over the flange of the replaced cylinder and retightening the bolts.

BRIEF DESCRIPTION OF DRAWINGS

The present invention is illustrated with respect to particular preferred embodiments thereof in the accompanying drawings, wherein.

DESCRIPTION OF PREFERRED EMBODIMENTS

Figure 1:
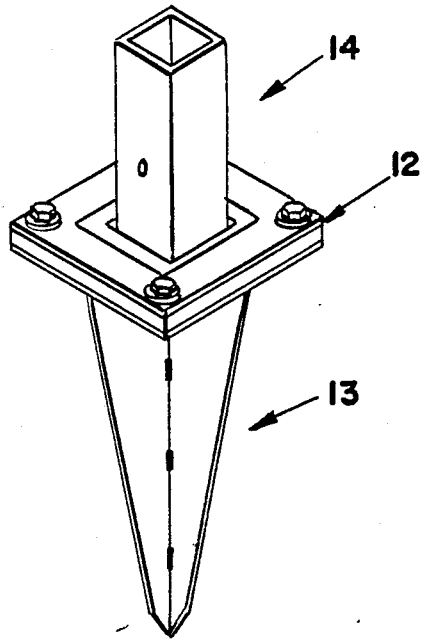
FIG. 1 is a projected view of a preferred embodiment of the present invention.
Figure 3:
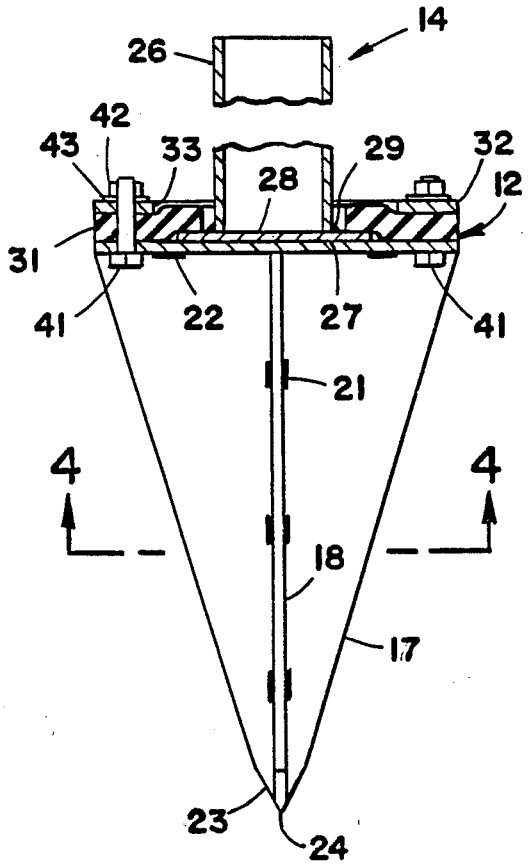
FIG. 3 is a longitudinal sectional view taken in the plane 3—3 of FIG. 2.
Figure 2:
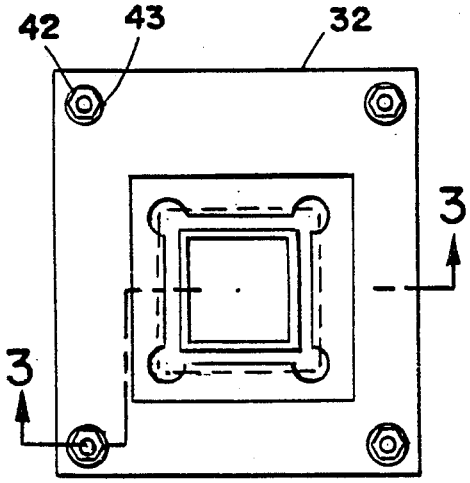
FIG. 2 is a top plan view of the system of FIG. 1.
Figure 4:
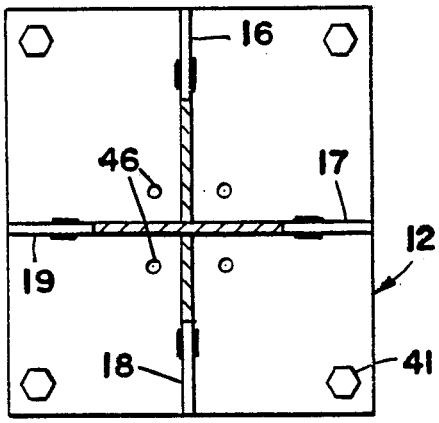
FIG. 4 is a transverse sectional view taken in the plane 4—4 of FIG. 3.

The present invention is basically comprised of three major functional components which may be physically embodied in a variety of manners and combinations. The present invention may also be provided with a "break away" function whereby an upper portion may be physically separated from the lower portion by impact without damaging the system.

Reference is first made to FIGS. 1 through 4, illustrating one preferred embodiment of the present invention. As shown in these figures, the system 11 hereof includes a rigid horizontal ground plate 12 from which depends a blade portion 13 and upon which is mounted an upright post receiving member 14. The plate 12 is formed of a strong rigid material such as steel and the blade portion 13 is formed of four, like, rigid blades 16, 17, 18 and 19. Each of these blades have a tapered configuration from a substantial width at the top to a narrow width at the bottom and are also formed of a strong rigid material such as steel. The blades 16 to 19 are assembled in orthagonal arrangement and are welded together, as indicated at 21, either by intermitent welds or continuous welds in order to form a rigid unit. In addition, the blade assembly 13 is welded to the underside of the ground plate 12 as indicated, for example, at 22. At the bottom of the blade assembly 13, the individual blade 16–19 are preferably additionally tapered inwardly as indicated at 23 to form a point 24 at the bottom of the assembly.

The post receiving member 14 is mounted atop the rigid ground plate 12 in either fixed position thereon, or as illustrated in FIGS. 1 through 4, is mounted in a "break away" fashion so that a major lateral blow applied to a post carried by the present invention will cause the post receiving member 14 to become separated from the lower portion of the system without damaging or destroying the major part of the system in the ground. In this respect, reference is again made to FIGS. 2 and 3 of the drawings wherein it will be seen that the post receiving member 14 is formed as a hollow rectangular cylinder having rigid vertical walls 26 formed or steel or the like. The cylinder 14 is provided with a rigid flange 27 about the bottom end thereof and, in the illustrated embodiment, this is provided by securing a heavy rigid plate 28 across the bottom end of the cylinder and extending laterally outwardly therefrom to form the flange 27. The plate 28 is attached to the cylinder 14 as by welding same together about the exterior of the lower end of the cylinder, as indicated at 29.

The flanged cylinder 14 rests upon the upper side of the ground plate 12 at the center thereof, and a centrally apertured retainer 31 is disposed about the cylinder 14 atop the flange 27 in extension outwardly over the ground plate 12. This retainer 31 is formed of a high density rubber or the like having a substantial thickness and limited flexibility. The retainer 31 is mounted upon the ground plate by means of an upper rigid plate or rim 32 having a central aperture 33 that is slightly larger than the plate 27 affixed to the bottom of cylinder 14 to form the flange 27 thereabout. This upper plate 32 is also formed as a rigid structural element from steel or the like and is attached to the ground plate by clamping means such as bolts 41 extending upwardly through the ground plate, retainer 31 and the upper plate 32 with nuts and washers 42 and 43 provide atop the upper plate 32 in engagement with the bolts. Tightening the nuts 42 on the bolts 41 will clamp the retainer 31 between the ground plate 12 and upper plate 32 to force the retainer tightly against the cylinder flange 27 so as to lock the cylinder or post support means 14 onto the ground plate 12.

The present systems, as described above also includes mating apertures 46 through the bottom plate 28 of the cylinder 26 and the ground plate 12 so that water may drain from the post receiving member 14 to prevent rotting of the bottom of a post received therein als. Also an aperture 48 in the cyclinder wall 26 allows a lag bolt to be inserted in a post. In addition it is noted, with regard to the "break away" function hereof, that the flange plate 28 has a lesser lateral dimension than the aperture 33 in the upper plate or rim 32 and, further, that the retainer 31 preferably has semicircular corner extensions 47 that extend beyond the corners of the flange plate 28 so that the flange 27 may be forecably pivoted out of the system without rupturing the retainer sheet 31.

The system as described above is adapted to be driven into the ground as, for example, by a conventional slide hammer. For relatively small systems, it is possible to use a manual side hammer to repeatedly strike the plate 28 and drive the system into the ground until the ground plate 12 engages the surface of the ground. For larger systems, a truck-mounted hydraulic slide hammer is employed.

Once the unit has been installed by driving it into the ground, it is available to support and anchor an upright post dimensioned to fit into the post receiving member or cylinder 14. It will be appreciated that different sized post receiving members may be provided so to snugly accommodate a four by four post, a two by six post or a round metal post. Posts supported and anchored by the present system may, for example, be employed to mount road signs or other types of signs or may be employed for a wide variety of other purposes.

Considering an application of the present invention to mount posts for road signs, it is noted that same are often located adjacent highways, freeway or the like and are thus subject to being struck by errant vehicles normally above the top of the post receiving member 14. Such an impact would break a post employed for this purpose and in fact provision is made to ensure that the posts is not sufficiently immobile to cause a vehicle to be forcibly reversed in direction. It is preferably for the post to be destroyed rather than for a vehicle to be bounced back into a roadway and with conventional post mounting with concrete about the bottom of the post in a hole in the ground, the post is broken off and replacement is both costly and difficult. Some four foot of wood post would be left in the ground and the problem of excavating the concrete around the bottom of the post would be time consuming and costly in order to replace the post. The present invention, on the other hand, provides for a major impact on the post to separate the post receiving member 14 from the remainder of the system embedded in the ground. Thus, a large lateral force or impulse applied a post extending upwardly from the present system will be transmitted to the cylinder 14 which causes same to be pivoted with the flange 27 thereof forcing the limitedly resilient retainer 31 upwardly so that the cylinder 14 and bottom plate 28 pivots out of the retainer and upper plate through the central opening 33 in the upper plate. The limited resiliency of the retainer 31 allows the retainer to be deformed under sufficient pressure so that the flanged cylinder can pivot upwardly and outwardly of the system.

Replacement of a post that has been impacted by a vehicle, for example, may be readily accomplished by removing the nuts 42 from the bolts 41 and lifting the upper plate 32 and retainer 31 from the ground plate 12. The flanged post supporting member 14 or a replacement thereof may then be replaced upon the ground plate and the retainer and upper plate returned to position so that nuts 42 can be threaded back on the bolts, and the system is again ready to support and anchor a post in extension upwardly therefrom. The lower portion or blade portion of the present invention is thus preserved from damage and is ready for reuse even after a catastrophic collision between a vehicle and post carried by the present invention.

It is also to be noted in that the system hereof is adapted to very firmly anchor a post carried thereby. Thus, the ground plate has a substantial width, such as three to four times the lateral dimension of the post receiving member, to extend well beyond the lateral dimension of a post to be supported, and the orthagonal blades 16 to 19 have a substantial width or depth at the top thereof so that it is virtually impossible to move the blade portion laterially once it has been driven into the ground. Any attempt to tilt the unit would require bending of the structurally rigid ground plate 12 so that the system hereof is truly immobile in the ground. This is particularly important when it is considered, for example, that signs carried by posts supported by the present system must be capable of withstanding substantial wind loads up to fifteen pounds per square foot with winds at a velocity of sixty miles per hour and gusts up to one hundred miles per hour. The substantially flat surfaces of the blade assembly and ground plate provide such an extensive contact with the ground that lateral movement of the system is substantially precluded under even extreme circumstances.

Figure 5:
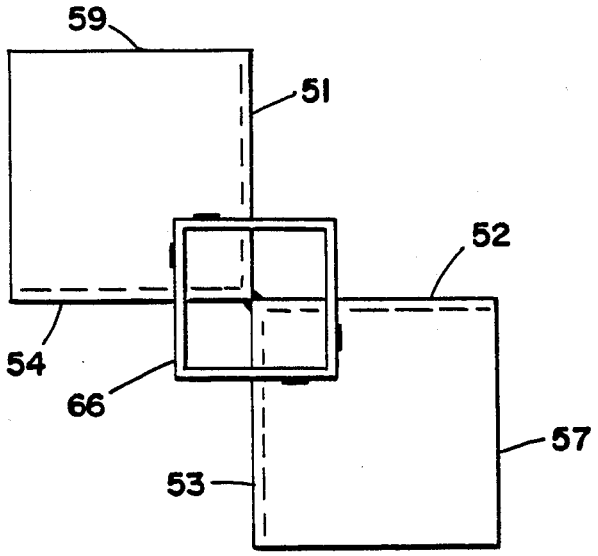
FIG. 5 is a top plan view of an alternative embodiment of the present invention.
Figure 6:
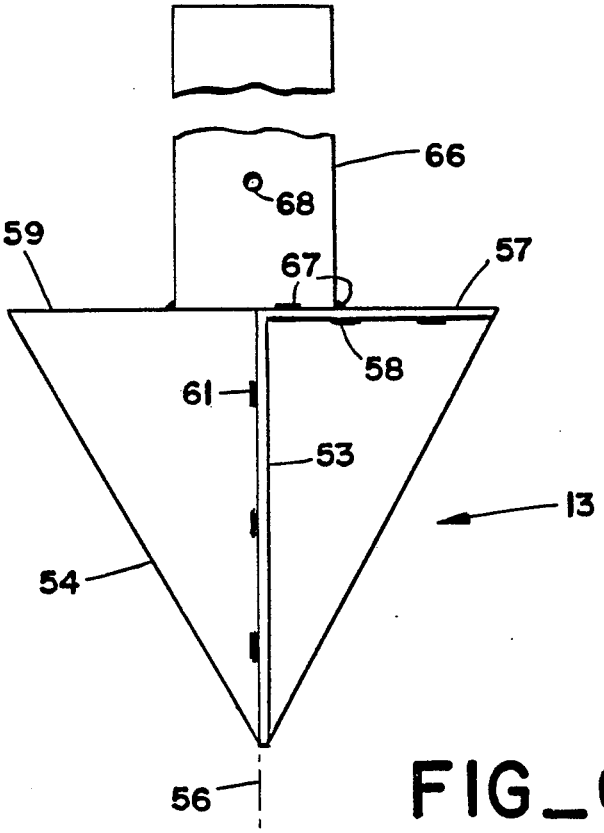
FIG. 6 is a side elevational view of the embodiment of the invention of FIG. 5.

The present invention is capable of being constructed in a variety of ways and a further and particularly advantageous embodiment of the invention is illustrated in FIGS. 5 and 6. Referring to these figures, it will be seen that the embodiment thereof is constituted of three major physical elements which combine to provide the three functional portions of the present invention, ie, ground plate, blade assembly and post receiving member. The blade assembly 13 comprises four orthagonally disposed tapered plates or blades 51, 52, 53 and 54 joined together along common straight edges comprising a central axis 56 of the system. The blades are formed of a rigid, structurally strong material, such as steel and the blade assembly is formed as two units, as described below. Two of the blades 52 and 53 are formed of a single piece of material having the outer edges tapered together downwardly and folded or bent along the center line to dispose the blades 52 and 53 in perpendicular orientation. One of the blades 53, for example, has a square tab 57 extending upwardly from the top thereof and which is subsequently bent or folded over perpendicularly to the blade for engagement with the top of the blade 52 which has the top edge slightly inset to receive the tab, as indicated in FIGS. 5 and 6. The tab 57 is attached to the blade 52 as by welds 58 to form a rigid unit. The blades 51 and 54 are similarly formed with a tab 59 the blade 54 folded over and attached to the top of the other blade 51. The two blade units are disposed with the fold axes contiguous and the blades disposed in perpendicular relationship to each other and welded together as indicated at 61 to thus form the blade assembly 13 and a ground plate comprising the tabs 57 and 59.

In addition of the foregoing, the embodiment of the present invention illustrated in FIG. 5 and 6 includes an upright hollow cylinder 66 which may have a rectangular configuration, as shown, and having the vertical axis thereof disposed on the axis 56 of the system. The cylinder 66 is firmly affixed to the tabs 57 and 59, as be welds 67, to form a single intergral structural system. It will be appreciated that the cylinder 66 is open at the bottom in opposite rectangular quadrants for ready drainage of the cylinder to prevent possible accumulation of moisture that could rot the bottom of a post fitted into the cylinder.

The simplified embodiment of the present invention described immediately above will be seen to provide a support and anchor for a post or the like adapted to extend upwardly therefrom. The blade assembly 13 is adapted to driven into the ground as by a slide hammer operating through the hollow cylinder 66 until the ground plate comprising the tabs 57 and 58 firmly engage the top surface of the ground. This operation can be readily accomplished in much less time than it is possible to dig a post hole and secure a post in a hole. It is also noted that the upright hollow cylinder 66 or post receiving means is preferably provided with at least one lateral aperture 68 for receiving a lag bolt or the like that may be screwed into a post disposed in the cylinder to secure the post in the system of the present invention. The physical arrangement of elements of this embodiment is advantageous in minimizing the cost of construction and this structure is thus highly advantageous for many applications.

There have been described above two preferred embodiments of the system of the present invention adapted to support and anchor an upright post received and retained by the system thereof. Not only is the present invention advantageous in rapid insertion in the ground, but is also advantageous in ready removal from the ground by applying a vertically upward force thereof. Removal of the blade assembly from the ground leaves only four slots on the ground in distinction to a large hole that would be left from the normal post mounting means. The substantial lateral extent of the ground plate hereof, and the orthagonal arrangement of blades of the blade assembly prevents loosening of the support by lateral forces that may be applied to the post inasmuch as tilting of the present system once it has been inserted in the ground is substantially impossible. It will also be appreciated that the system of the present invention may be constructed in a variety of sizes and having post support members of varying configurations to receive square, rectangular or round posts.

Although the present invention has been described above with respect to particular preferred embodiments thereof, it will be apparent to those skilled in the art that numerous modifications and variations may be made within the spirit and scope of the present invention, and thus it is not intended to limit the invention to the terms of description of details of illustrations.

What is claimed is:

1. A support anchor and system for a post comprising a rigid blade assembly having four blades disposed orthagonally and tapered inwardly from top to bottom to form a bottom point for insertion in the ground, a rigid ground plate secured across the top of said blade assembly for engaging the surface of ground in which said blade assembly is inserted, a post receiving member having a hollow upright configuration with a flange thereabout disposed upon said ground plate for mounting a post in extension upwardly from said system, a limitedly resilient retainer sheet having a central aperture and disposed about said post receiving member upon said flange and ground plate, and means clamping said retainer to said ground plate about the periphery of said retainer, whereby said post receiving member is mounted upon said ground plate via said resilient member so that said post receiving member and flange thereon is pivotally separable from said ground plate by pivotal forces applied to said post receiving member.

2. The system of claim 1 further defined by said ground plate being comprised of two tabs with each extending between two separate blades.

3. The system of claim 1 further defined by said ground plate and blade assembly being comprised of two like units with each unit having a pair of tapered blades extending perpendicularly to each other from a common straight edge and tapered to a point at a bottom end of said common edge, and a rigid tab extending across the large top ends of said blades in connection thereto, said two units being fixed together along said common straight edges to dispose said blades in orthagonal array and said tabs in a common plane whereby said ground plate is comprised of said tabs with said blade assembly depending therefrom.

4. The system of claim 1 further defined by said means clamping said retainer including a rigid apertured plate disposed upon said retainer about said post receiving member and flange with the aperture therein being larger than said flange, and releasable clamping means joining said apertured plate to said ground plate and holding said retainer sheet therebetween, whereby said post receiving member is mounted on said ground plate for pivoting therefrom upon application of sufficient force to resiliently deform said retainer sheet.

5. The system of claim 4 further defined by said retainer sheet being formed of a thick high density rubber and said clamping means including elements extending through said retainer sheet about the periphery thereof.

6. The system of claim 4 further defined by said retainer sheet having the aperture therethrough having semicircular corner extensions extending outwardly beyond corners of the flange about said post receiving member for maintaining integrity of said sheet during pivotal movement of the flange of said post receiving member through said aperture.

7. The system of claim 1 further defined by said ground plate having lateral dimensions at least three times the lateral dimensions of said post receiving member and said blade assembly having the top thereof extending substantially to the outer edges of said ground plate.

8. A post support and anchor system comprising a hollow upright post-receiving member having a flange about a lower end thereof and adapted to receive and support a post in upright extension therefrom, a rigid blade assembly having a rigid ground plate adapted to support said post receiving member by said flange thereon with four orthagonally disposed blades depending therefrom and tapering inwardly therefrom to form a bottom point for insertion in the ground with the top of said blade assembly having lateral dimensions of substantially three or more times the lateral dimensions of the upright portion of said post receiving member, a limitedly resilient retainer sheet having a central aperture therethrough that is smaller than the flange about said post receiving member and disposed upon said flange, a rigid plate having a central aperture larger than the flange about said post receiving member and disposed upon said retainer sheet, and clamping means joining said apertured plate to said ground plate for holding said retainer sheet therebetween, whereby said post receiving member is releasable from said blade assembly by forcible pivoting of said flange out of said retainer sheet.

9. The system of claim 8 further defined by said flange having corners and said retainer sheet having the central aperture smaller than the dimensions of flange and having extensions laterally beyond the corners of said flange for permitting said flange to be forceably pivoted out of the aperture in said retainer sheet without damage of said retainer sheet so that the system may be subsequently reassembled after the post receiving member has been forceably removed from said blade assembly.

* * * * *